United States Patent [19]

Carli

[11] 4,414,778

[45] Nov. 15, 1983

[54] TAPE DRIVE DOOR OPERATOR

[75] Inventor: Alvin J. Carli, Sebring, Ohio

[73] Assignee: The Alliance Manufacturing Company, Inc., Alliance, Ohio

[21] Appl. No.: 253,689

[22] Filed: Apr. 13, 1981

[51] Int. Cl.[3] ..... E05F 11/00

[52] U.S. Cl. ..... 49/199; 74/89.21

[58] Field of Search ..... 49/199, 200, 352, 139, 49/140, 26, 28, 325, 374, 375; 74/89.2, 89.21; 160/193

[56] References Cited

U.S. PATENT DOCUMENTS

| | | | |
|---|---|---|---|
| 3,195,617 | 7/1965 | Berry et al. | 160/193 |
| 3,252,503 | 5/1966 | Jackson | 160/193 |
| 3,858,452 | 1/1975 | Gatland et al. | 49/199 X |
| 4,311,225 | 1/1982 | Tsubaki et al. | 74/89.21 X |

FOREIGN PATENT DOCUMENTS

| | | | |
|---|---|---|---|
| 598489 | 10/1959 | Italy | 49/360 |

*Primary Examiner*—Kenneth Downey

*Attorney, Agent, or Firm*—Pearne, Gordon, Sessions, McCoy, Granger & Tilberry

[57] ABSTRACT

A garage door operator is provided which includes a flexible, elongated tape within a relatively rigid, elongated guide rail mounted in a garage. The tape has first and second runs longitudinally disposed in first and second guide channels in the guide rail. A motor is connected to drive a drive wheel with the tape wrapped around a part of the drive wheel and having a positive drive engagement therewith. A carriage is longitudinally guided on the guide rail and is connected both to the tape for movement therewith and by a link to a garage door for opening and closing movements of the door. The guide rail may be cut into sections for a shorter shipping package, and the tape coiled in a loop during shipment but then disposed within the guide channels during operation, the guide rail being spliced into one long, continuous assembly for use in the garage. The foregoing abstract is merely a resume of one general application, is not a complete discussion of all principles of operation or applications, and is not to be construed as a limitation on the scope of the claimed subject matter.

22 Claims, 6 Drawing Figures

TAPE DRIVE DOOR OPERATOR

BACKGROUND OF THE INVENTION

Garage door operators have been gaining in popularity and have evolved into two separate types for the majority of door operators produced in the United States. The first type is a screw drive and the second is a chain drive. The screw drive type of door operator is over 22 years old, as shown, for example, by U.S. Pat. No. 2,954,224. The screw drive type utilizes a one, two or three-start thread screw, disposed near the ceiling of the garage, and in the order of one-half inch diameter, with about 300 degrees of the screw enveloped and guided within an elongated guide rail. A partial nut is guided by the guide rail and engages the screw in the remaining exposed, about 60-degree, arcuate extent of the screw. The partial nut is connected to the garage door for establishing opening and closing movements, depending on clockwise or counterclockwise rotation of the screw.

The chain drive type of garage door operator utilizes an elongated guide channel, again disposed near the ceiling of the garage, and journaling the drive sprocket and an idler sprocket at opposite ends over which first and second runs of a link chain are trained. A carriage slides on the guide channel and is connected to one run of the chain for forward and reverse movements for opening and closing movements of the door. In the chain drive type of door operator, the guide channel for many years has been cut into two or three pieces for compactness of the shipping container and spliced together end-to-end at the garage site for use.

In order to be useful throughout the United States, both types of garage door operators must be usable with a large majority of the different types of garage doors in use. There are sectional doors of three, four, or five sections which move upwardly on a track to a position inside the garage and over the space in the garage for the automobile. Another door is a slab door of one piece which moves upwardly and outwardly to a position partially in and partially outside the garage as a canopy in a generally horizontal position. Another single slab-type door is one which moves on hardware upwardly and inwardly to a position entirely within the garage into a generally horizontal attitude. To be satisfactorily merchandised, both the screw drive and chain drive type of door operator must operate satisfactorily with at least these three different types of garage doors, and such types in a full range of common sizes.

The screw drive door operator currently enjoys the largest market share, one reason being that most of the screw is contained within the guide rail, with the slotted opening along the bottom edge for the partial nut. Therefore, lubrication of the screw may satisfactorily be provided for long life. On the other hand, the chain drive door operator is one which has the chain and sprockets relatively exposed, hence being much more subject to contamination, and therefore wear, for a more limited life. The fact that the chain drive door operator could have a rail cut into sections for a shorter package was a shipping advantage over the screw drive operator, which, until recently, was still shipped in a package about ten feet long. The doors with which both types of operator were used varied in height from 6½ to 8 feet, so that a guide rail about 9 or 10 feet long mounted along the garage ceiling was generally required in order to be able to satisfactorily operate the great majority of garage doors installed in garages throughout the United States.

More recently, there has appeared on the market a screw drive operator, shown in U.S. Pat. No. 4,241,540, wherein the guide rail is provided with splice plates and the screw is provided with a double pivoted coupling so that the screw part and associated guide rail part may be folded upon itself for a shipping carton about half the total length of the unfolded and spliced guide rail. This shortens the length of the shipping package but introduces further problems of wear at the double pivoted coupling and shortened life of the product.

Installation of garage doors by a service man is becoming increasingly more expensive, and therefore a simplified door operator construction which may be installed by the homeowner is desirable. The average professional installer will have a truck to transport a 10-foot long package, but the average homeowner needs a shorter package so that he may take it home in the trunk of his automobile. Also, the average homeowner does not lubricate his garage door operator, not even once in five years, so a garage door operator which is troublefree without yearly lubrication is desirable.

The problem to be solved, therefore, is how to construct a garage door operator which is competitive in price, operable for a long life in relative quiet and safety without contamination of lubrication, and which may be packaged for shipping in a relatively short carton, yet which will be operable with the great majority of upward acting garage doors currently in use in the United States.

SUMMARY OF THE INVENTION

This problem is solved by a garage door operator comprising, in combination, a base, elongated guide rail means having one end secured to said base and adapted to be mounted in a garage in a direction substantially parallel to at least part of the opening and closing movement of a garage door, first and second lengthwise channels in said guide rail means a motor, a drive wheel journalled on said base, means connecting said drive wheel for drive by said motor, a flexible elongated tape having a first run longitudinally disposed in said first guide channel and a second run disposed in said second guide channel, means establishing a positive drive engagement between a portion of said tape and an arcuate portion of the periphery of said drive wheel, a carriage longitudinally guided on said guide rail means, means interconnecting said carriage and said tape for movement therewith, and a link connected to said carriage and adapted to be connected to any said garage door for opening and closing movements by movement of said tape.

Accordingly, an object of the invention is to provide a garage door operator with a flexible tape which may be guided in an elongated guide channel and which requires no separate lubrication.

Another object of the invention is to provide a tape drive garage door operator wherein the tape is utilized in tension for opening movements and in compression for closing movements of the garage door.

A further object of the invention is to provide a garage door operator wherein the operator may be knocked down and shipped in short sections for a compact door operator with a flexible tape formed into a coil, yet which is readily assembled at the garage site.

Other objects and a fuller understanding of the invention may be had by referring to the following description and claims, taken in conjunction with the accompanying drawing.

DESCRIPTION OF THE PREFERRED EMBODIMENT

Figures 1, 2, 3:
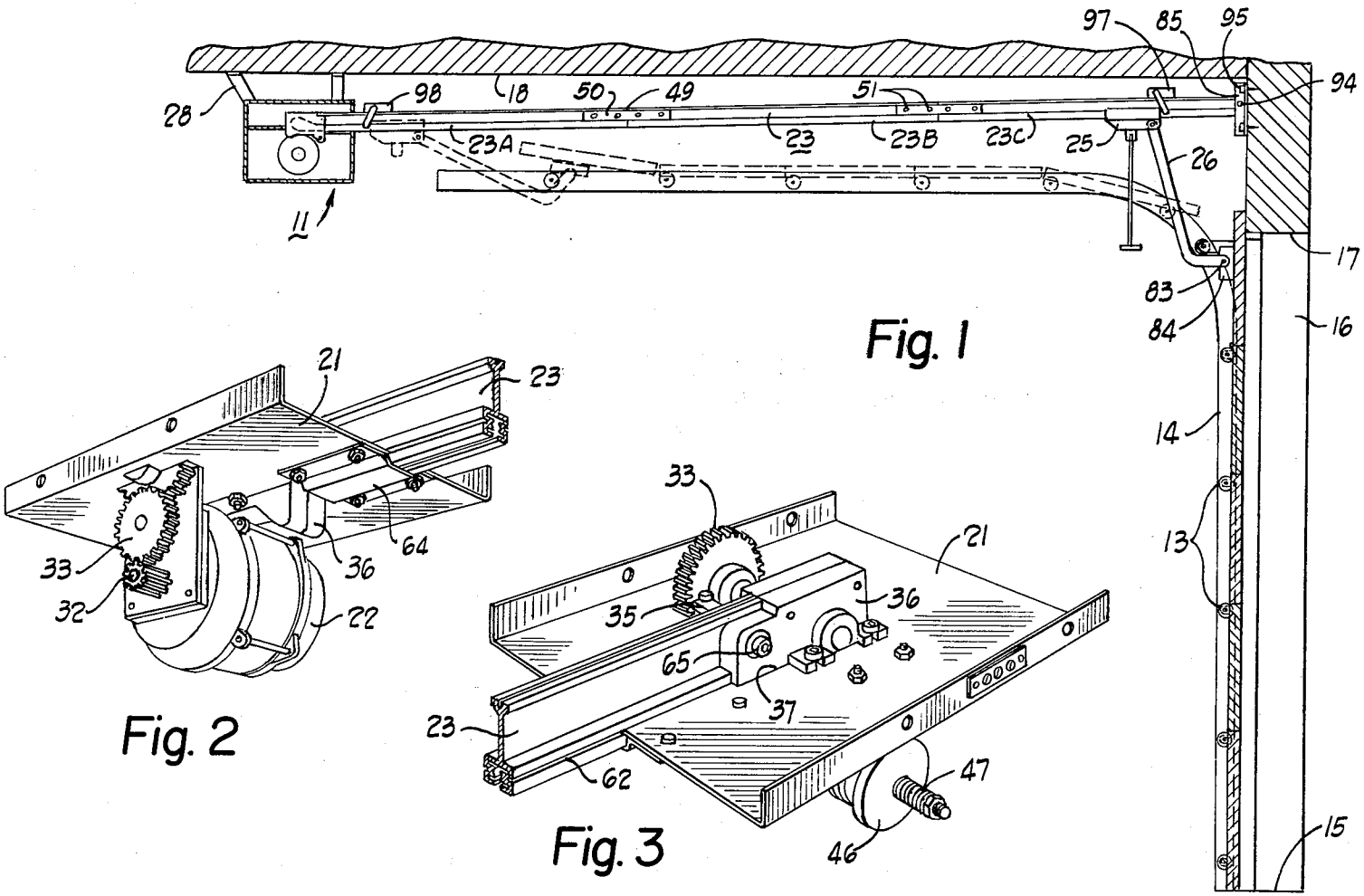
FIG. 1 is a side elevational view of a garage door constructed to be movable by a garage door operator according to the invention.
FIG. 2 is a perspective view of the motor drive end of the door operator, with the cover removed.
FIG. 3 is a perspective view from the upper side of the motor drive end of the garage door operator.

The figures of the drawings show a garage door operator 11 for use with a garage door 12, which may be one-piece door which is upward acting but is shown as a door having five sections with rollers 13 rolling in a guide channel 14 so as to be movable from a closed position shown in solid lines to an open position shown in dotted lines. When closed, the door 12 rests on a door sill 15 and closes a door frame opening 16, which opening has a door header 17, and the garage in which the door is used has a ceiling 18.

The garage door operator 11 includes generally a motor base 21, a motor 22 mounted on the base 21, guide rail means 23 which guides a flexible tape 24, a carriage 25, and a link 26. The base 21 may be of sheet metal, and is adapted to be secured to the ceiling 18 of the garage by any suitable mounting support 28. The motor 22 is preferably an electric motor and is connected in some manner to drive a drive wheel 29, shown in FIG. 4. In the preferred embodiment, this drive connection is one wherein the motor 22 has a drive pinion 30 driving a gear 31 which is coaxial with and connected to a pinion 32 which meshes with and drives a gear 33. This gear 33 is fixed on a shaft 34 which is journaled in a bearing block 35 near one end of the shaft and the other end of the shaft is journaled in a drive wheel housing 36. This drive wheel housing is mounted in an aperture of the base plate 21 to extend partly above and partly below this base plate. The housing 36 is also formed in two halves split perpendicular to the shaft 34, receiving one end of the guide rail means 23 between the two halves. The drive wheel 29 is keyed on the shaft 34 and is disposed inside the housing 36. The flexible tape 24 may be formed of Delrin or some suitable long-chain polymer so as to be flexible, resilient, and self-lubricating in the guide rail means 23. A positive drive connection between the drive wheel 29 and flexible tape 24 is provided, with this positive drive connection being formed by projections on either the tape or the wheel entering apertures on the other member. As shown in the preferred embodiment, the drive wheel 29 has projecting teeth 38 entering apertures 39 on the tape 24. The housing 36 includes walls 40 defining slots 41 and 42 which guide the tape 24 into first and second runs 43 and 44 and guide the tape around and into drive engagement with the drive wheel 29. The slots 41 and 42 guide the tape so that the tape has drive engagement in excess of 180 degrees with the drive wheel 29, and, as shown, this is preferably about 200 degrees of drive engagement.

The motor 22 may be provided with a safety clutch 46 urged into engagement by a clutch spring 47, and this clutch will slip upon overload, whereupon a safety switch, not shown, may be actuated to de-energize the motor 22. The guide rail means 23 is shown as being formed in three pieces 23A, 23B, and 23C, which are butted together at joints 49 and then spliced by means of splice plates 50 and fasteners such as bolts 51. There may be one splice plate at each joint 49, or there may be a pair of splice plates one on each side of the guide rail means 23. These three guide rail sections 23A, 23B, and 23C are normally shipped disassembled in order to achieve a shorter length of shipping carton, and are assembled end-to-end to make a complete guide rail assembly at the garage site.

Figure 4:
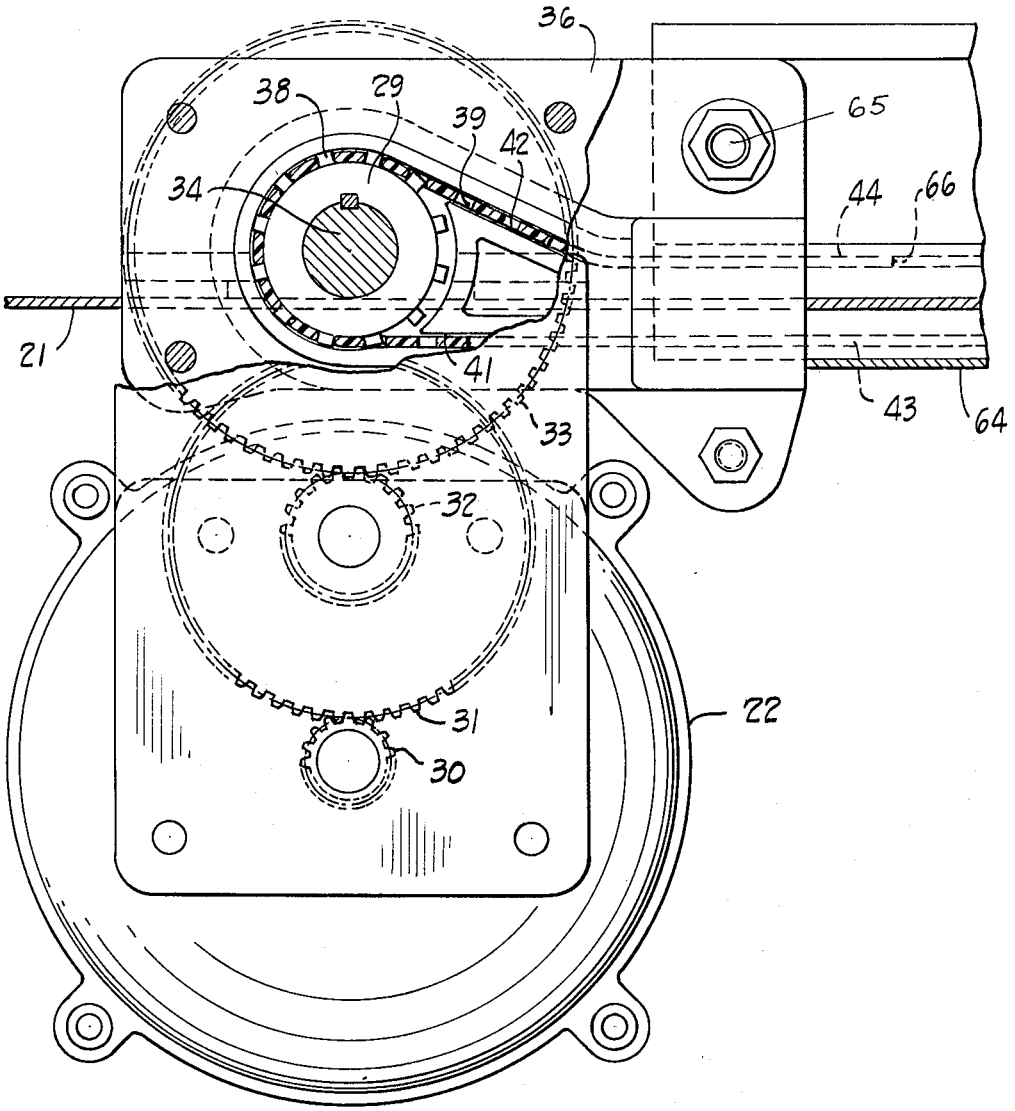
FIG. 4 is an enlarged, side elevational view of the motor drive end of the door operator, and partially in section.
Figure 5:
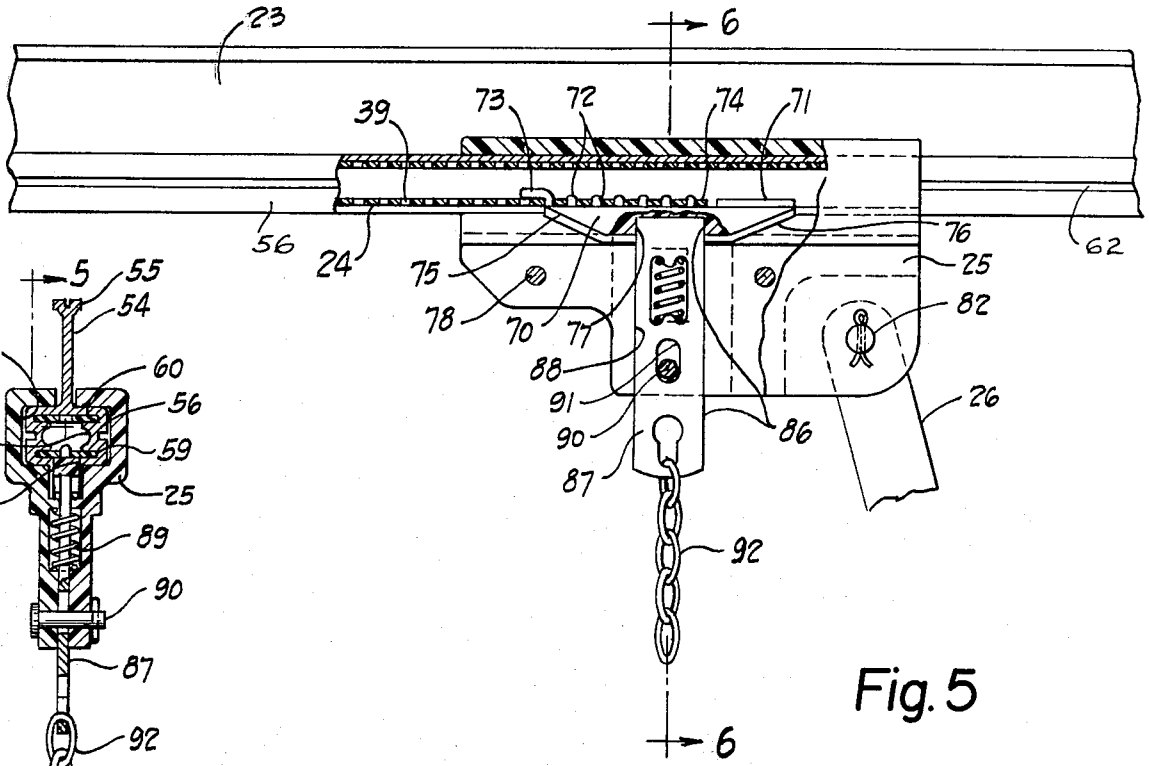
FIG. 5 is an enlarged, side elevational view of the carriage and rail assembly and partially in section on line 5—5 of FIG. 6.
Figure 6:
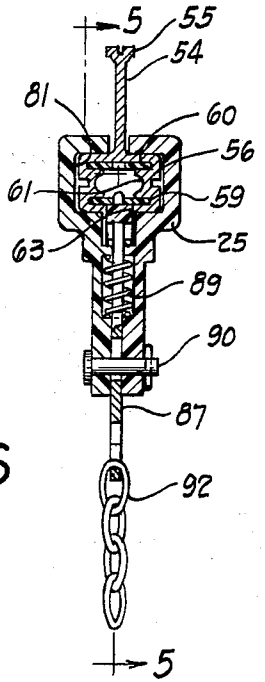
FIG. 6 is a sectional view on line 6—6 of FIG. 5.

FIGS. 4, 5, and 6 better illustrate the guide rail means 23, with FIG. 6 illustrating that it was a web 54 interconnecting an upper flange 55 and a lower flange 56. The rail 23 may be of extruded aluminum, for example, to be a stiff, rigid member relative to the tape 24. Both of these flanges add stiffness to the guide rail means 23. The lower flange 56 is thickened in a vertical direction, as mounted, in order to provide first and second guide channels 59 and 60, respectively, with a wall 61 therebetween which defines generally an oval cross section open space. Centrally located longitudinally of the lower flange 56 are two opposite slots 62, and a lower slot 63 provides access to the first guide channel 59.

In FIGS. 3 and 4, it will be noted that the motor end of the guide rail means 23 enters the drive wheel housing aperture 37 in the motor base plate 21, with the base plate fitting within the slots 62 of the guide rail 23 in order to position this guide rail. A plate 64 is clamped to the base plate 21, and also a bolt 65 secures the motor end of the guide rail means 23 to the drive wheel housing 36.

FIGS. 5 and 6 better show the means of connecting the door operator 11 to the garage door 12. From FIG. 4, it will be noted that the first run 43 of tape 24 enters the lowermost or first guide channel 59 and the second run of tape 44 is guided to enter the uppermost or second guide channel 60.

In the position shown in FIG. 1, with the door 12 closed, the tape 24 has a length to reach through the carriage 25, substantially filling the entire length of the first guide channel 59, and then it wraps around the drive wheel 29 and enters a short distance in the second guide channel 60, with the end of the second run of tape 44 being at about the location 66 in FIG. 4. Therefore, it will be seen that the tape 66 is not an endless piece of tape, but need be of a length only sufficient to lie along the length of the guide rail means 23 with enough extra to enter the other guide channel. The second guide channel 60 is thus a storage channel for the unused end of the tape.

FIGS. 5 and 6 illustrate a slide block 70 which may be made of nylon, for example, to be self-lubricating. This slide block has a flange 71 which enters in and slides in the first guide channel 59. Projections 72 are provided on the upper surface of the slide block 70 plus a locking projection 73. The first run of tape 43 has an end 74 close to the flange 71 and the apertures 39 in the tape engage the projections 72 and the locking projection 73.

Ramps 75 and 76 are provided on the lower surface of the slide block 70 on either side of a recess 77.

The carriage 25 is made of nylon, Delrin, or a glass-filled polyester resin to be self-lubricating relative to the guide rail means 23. The carriage 25 is made in two halves fastened together by rivets 78. The carriage 25 has a channel 81 disposed on the upper part thereof to embrace and slide along the lower flange 56 of the guide rail means 23. The link 26 is an L-shaped door arm which is pivoted by a pin 82 to the carriage 25, and the other end of this link 26 is pivoted by a pin 83 to a bracket 84 secured to the upper part of the door 12. As noted in FIG. 1, a bracket 85 secures the door end of the guide rail means 23 to the door frame header 17 to take the thrust of opening and closing of the door 12. The slide block 70 is interconnected with the carriage 25 by means of an interlock 86. This interlock includes a latch 87 and the recess 77. The latch 87 is disposed in a guide channel 88 in the carriage 25. A compression spring 89 urges the latch 87 upwardly toward engagement in the recess 77 and a cross pin 90 in a slot 91 limits the extent of movement of this latch 87. A chain 92 is connected to the lower end of the latch 87, and may be pulled to disengage the interlock 86.

OPERATION

FIG. 1 shows the garage door operator 11 as assembled. Initially, for shipping, the garage door operator would be shipped in a much shorter shipping carton. The three guide rail sections 23A, 23B, and 23C would be side-by-side in a shipping carton of only about 3 or 3½ feet in length. The flexible tape 24 preferably would be threaded through the drive wheel housing 36, with the lower, long end formed into a coil of about 6 or 8 inches in diameter. The motor, gear unit and base plate would be preassembled and would determine the thickest part of the shipping carton.

To assemble the door operator 11, the splice plates 50 and fasteners 51 would be used to assemble the three sections of the guide rail into one elongated, rigid guide rail means 23. The door header bracket 85 could already be attached to one end of the guide rail means 23 by means of a pivot pin 94. The flexible tape could be unrolled and the locking projection 73 inserted through the seventh aperture from the end 74 of the flexible tape 24. The flange 71 on the slide block 70 would then be inserted into the motor end of the guide rail means 23, and this slide block 70 and the end of the tape slid into this first guide channel 59 any desired amount, and preferably for about the entire length of this guide rail means 23. The second end of the tape 66 would be already preassembled around the drive wheel 29, and extending a short distance out of the upper slot 42. It would be slid into the second guide channel 60 and the motor end of the guide rail means 23 could then be fastened in place in the base plate 21 by the clamp plate 64 and the bolt 65. The proper position on the door header 17 for the bracket 85 could be located and this bracket secured by lag screws 95 to the door header 17. The motor 22 and base plate 21 could be raised into position with the door operator 11 substantially horizontal and secured to the ceiling 18 by any suitable mounting support 28. The carriage 25 would be already in place on the guide rail means 23, and would be slid to about the position shown in full lines in FIG. 1. The link 26 would be fastened to the carriage 25 by the pivot pin 82 and the bracket 84 with the pivot pin 83 therein would be secured to the upper part of the door 12.

A DOWN limit switch 97 and an UP limit switch 98 would be slid along the guide rail means 23 to suitable positions to de-energize the motor 22 upon the carriage 25 reaching the closed and fully open positions, respectively. The electrical circuit may be the same as on the typical screw drive or chain drive operator. If the slide block 70 was not interlocked with the carriage 25, they could be interlocked in either of two ways. The door 12 could be actuated manually until the carriage 25 was moved to the position of the slide block 70, and as it approached, the latch 87 would ride along one of the ramps 75 or 76 to be cammed downwardly against the urging of the spring 89 and then the spring would force the latch into the recess 77 to interlock the slide block 70 and the carriage 25. Alternatively, the motor 22 could be energized and the tape moved within the guide rail means 23 to have the slide block 70 approach the carriage 25. At the final approach, the ramp surface 75 or 76 would depress the latch 87 and then the spring 89 would cause this latch to engage the recess 77 to complete this interlocking.

The assembled door operator 11 is one which has a guide rail means 23 adapted to be installed so that this guide rail is parallel to at least part of the movement of the garage door 12. As illustrated in FIG. 1, this is a horizontally disposed guide rail, with a part of the door movement being substantially horizontal. The flexible tape 24 is discontinuous, having first and second ends 74 and 66. This achieves an economy in the amount of tape used, and this is possible because the tape may have a thickness of about 0.085 inch and a width of about 1 inch, so that even with the apertures 39, it has sufficient tensile and compressive strength for opening and closing movements, respectively, of the door 12. The door may have a weight of several hundred pounds, and may have an unbalanced or noncounterbalanced weight of 50, or even 100, pounds. It has been determined that this flexible tape 24, when loaded in tension for opening movements and loaded in compression for closing movements of the door, is satisfactory to establish such door movements. A further advantage is the inherent safety of this door operator. The tape 24 will withstand about twice as much stress in tension as in compression, while sliding in the guide rail. The typical garage door requires about twice as much upward opening force as downward closing force, so the inherent safety is achieved, because one prefers limited down force so as not to crush an object or person. The tape is relatively noise free, without lubrication, so this is another advantage. The tape will withstand the bending around a 1.5 inch diameter drive wheel 29 despite variations of temperature from −10° F. to 120° F., and be self-lubricating in the guide channels 59 and 60.

The latch 87 extends through the lower slot 63 in the guide rail lower flange 56 so as to engage the slide block 70. Since this elongated slot 63 is on the lower side of the lower flange 56, dust and other contaminants do not readily enter the first guide channel 59, making the use of any greasy lubricant unnecessary to inhibit the entrance of any grit or other abrasive particles which might limit the life of the tape 24 within this guide channel 59. Thus, an economical yet long-life door operator 11 is achieved. The slots 41 and 42 and the guide channels 59 and 60 may have a clearance of only about 0.002 to 0.008 inch relative to the flexible tape 24. This means that the tape will be closely enveloped and guided both on the two flat sides thereof and on the two edges thereof, so that the tape does not buckle while being loaded in compression, i.e., for the closing direction of movement of the door 12.

The guide rail means 23, initially shipped in three different sections, achieves the short shipping carton for ease and economy of shipping, and also ease of transporting home by the homeowner, and achieves a lessening of the marketing problems of such door operators. When the three sections are secured together by the splice plates 50, the first and second guide channels 59 and 60 are aligned for easy passage of the two ends of the tape from one section of the guide rail to the next. As will be observed in the drawings, the first and second guide channels 59 and 60 are substantially parallel so that the second end of the tape 66 may extend 8 or 9 feet into this second guide channel 60 when the door 12 is in the open position. This is a storage of the tape 24 during one condition of use of the door operator 11, and hence the tape 24 is encased at all times to prevent dust and dirt from getting on the tape, which could cause contamination and abrasive wear of the tape and guide channels.

From FIG. 4, it will be observed that the first and second guide channels 59 and 60 are spaced apart a distance less than the diameter of the drive wheel 29. This assures that the tape 24 extends around the circumference of this drive wheel 29 a distance greater than 180° for a satisfactory positive drive of the tape by the drive wheel 29.

The flexible tape 24, during use of the door operator 11, is stored at all times within the guide rail means 23 or the drive wheel housing 36. More specifically, it is stored within one of the upper and lower flanges 55 and 56 of this guide rail means 23 and, as shown in the preferred embodiment, is stored within the lower flange 56. The first guide channel 59 is disposed in the distal exposed edge of the lower flange 56 and the second guide channel 60 is disposed in the proximal edge of the lower flange 56, proximate the web 54. The lower flange 56 has an inverted, U-shape, with the base of the U-shape forming part of the second guide channel 60. This helps establish the stiffness of the guide rail means 23.

It will be noted that the lower flange 56 performs three functions: (1) it houses the first guide channel 59 for the first run 43 of tape 24; (2) it houses the second guide channel 60 for the second run 44 of tape 24; and (3) it provides the longitudinal guide for the carriage 25. The carriage 25 has the channel 81 which envelops a majority of the lower flange and is longitudinally guided therealong. The result is a door operator which has satisfactory economy, one which utilizes a short shipping package, one which is readily installed by a homeowner, and one which has a satisfactory long life.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A garage door operator comprising, in combination:

a base;

elongated guide rail means having one end secured to said base and adapted to be mounted in a garage in a direction substantially parallel to at least part of the opening and closing movement of a garage door;

first and second lengthwise guide channels in said guide rail means;

a motor;

a drive wheel journalled on said base;

means connecting said drive wheel for drive by said motor;

a flexible elongated tape having a first run longitudinally disposed in said first guide channel and a second run disposed in said second guide channel;

a web connected to a lower flange of the guide rail means;

said first and second tape guide channels being disposed in said lower flange;

means establishing a positive drive engagement between an arcuate portion of said tape and at least a 90° arcuate portion of the periphery of said drive wheel;

a carriage longitudinally guided on said guide rail means;

surfaces defining a longitudinal slot in said guide rail means;

means extending through said longitudinal slot and interconnecting said carriage and said first run of tape for movement therewith;

a link connected to said carriage and adapted to be connected to any said garage door for opening and closing movements by movement of said tape;

said first run of tape being stressed in tension during the opening movement of the door operator; and said first guide channel closely enveloping and guiding said first run of tape on both sides and both edges sufficiently to prevent any substantial buckling of said first run of tape under compression forces during closing movement of the door, yet transmitting to the door during closing movement a lesser force than during the opening movement for an increase in safety of door operation.

2. A garage door operator as set forth in claim 1, wherein said tape is discontinuous with first and second ends and with said first end in said first guide channel.

3. A garage door operator as set forth in claim 1, wherein said interconnecting means includes a member secured to said tape and a releasable connection between said member and said carriage.

4. A garage door operator as set forth in claim 1, wherein one of said drive wheels and said tape has lateral projections and the other has apertures receiving said projections to establish said positive drive engagement.

5. A garage door operator as set forth in claim 1 wherein said elongated guide rail means is rigid relative to said tape.

6. A garage door operator as set forth in claim 1, wherein said elongated guide rail means is in a plurality of pieces, and splice plates and fasteners adapted to connect said pieces coaxially into one elongated assembly.

7. A garage door operator as set forth in claim 1, wherein said first and second guide channels are substantially parallel.

8. A garage door operator as set forth in claim 7, wherein said drive wheel has a given diameter, and said first and second guide channels are spaced apart a distance less than said given diameter.

9. A garage door operator as set forth in claim 8, wherein said tape circumscribes and is in drive engagement with more than 180° of said drive wheel.

10. A garage door operator as set forth in claim 1, including an upper flange connected to the upper edge of said web.

11. A garage door operator as set forth in claim 1, including two outer slots one one each side of said lower flange and each disposed between said first and second guide channels.

12. A garage door operator as set forth in claim 1, wherein said second guide channel is disposed in said lower flange substantially perpendicular to said web.

13. A garage door operator as set forth in claim 1 wherein said lower flange is thickened in a direction parallel to said web, and said first guide channel is disposed in the distal exposed edge of said lower flange and said second guide channel is disposed in the proximal edge of said lower flange.

14. A garage door operator as set forth in claim 13, wherein said lower flange has an inverted U-shape, with the base of the U-shape forming part of said second guide channel.

15. A garage door operator as set forth in claim 13, including walls in said lower flange disposed between said first and second guide channels and defining a space generally oval in cross section.

16. A garage door operator as set forth in claim 1, including guide means on said lower flange for guiding the longitudinal movement of said carriage.

17. A garage door operator as set forth in claim 1, wherein said carriage envelops a majority of said lower flange for longitudinally guided movements therealong.

18. A garage door operator as set forth in claim 1, wherein said interconnecting means includes a slide block, a flange on said slide block disposed in said first guide channel, and means for securing said slide block to said tape.

19. A garage door operator as set forth in claim 18, wherein said securing means includes projections on said slide block engaging apertures in said tape.

20. A garage door operator as set forth in claim 18, wherein said interconnecting means includes an interlock longitudinally connecting said slide block to said carriage.

21. A garage door operator as set forth in claim 20, including a laterally movable latch and a recess in said interlock establishing a releasable longitudinal connection between said slide block and said carriage.

22. A garage door operator as set forth in claim 21, including means urging said laterally movable latch toward said recess, and a ramp surface on said slide block to stress said urging means upon relative longitudinal approach movement of said carriage and said slide block to engage said interlock.

* * * * *